US006460710B1

(12) United States Patent
Dardashti

(10) Patent No.: US 6,460,710 B1
(45) Date of Patent: Oct. 8, 2002

(54) WIRE SHELVING WITH ADJUSTABLE DIVIDER ASSEMBLY FOR MULTIMEDIA AND THE LIKE

(76) Inventor: Shahriar Dardashti, c/o Atlantic, Inc., P.O. Box 2399, Sante Fe Springs, CA (US) 90670

( * ) Notice: Subject to any disclaimer, the term of this patent is extended or adjusted under 35 U.S.C. 154(b) by 0 days.

(21) Appl. No.: 09/591,914

(22) Filed: Jun. 9, 2000

(51) Int. Cl.[7] ..... A47B 57/58

(52) U.S. Cl. ..... 211/184; 211/187; 211/181.1; 108/61

(58) Field of Search ..... 211/187, 184, 211/181.1, 133.5, 133.2; 108/60, 61

(56) References Cited

U.S. PATENT DOCUMENTS

| | | | | | |
|---|---|---|---|---|---|
| 3,272,345 | A | * | 9/1966 | Wallace | 211/187 X |
| 3,739,918 | A | * | 6/1973 | Kreitzberg | 211/184 X |
| 3,800,958 | A | * | 4/1974 | Dorn | 211/181.1 X |
| 4,023,682 | A | * | 5/1977 | Niece | 211/184 |
| 4,099,624 | A | | 7/1978 | McKearin | 211/42 |
| 4,125,299 | A | | 11/1978 | Chamberlin | 312/184 |
| 4,562,928 | A | | 1/1986 | Erickson | 211/184 |
| 5,195,642 | A | | 3/1993 | Dardashti | 211/41 |
| 5,199,577 | A | | 4/1993 | Curtis | 211/40 |
| 5,205,420 | A | | 4/1993 | Petryszak | 211/43 |
| 5,553,720 | A | | 9/1996 | Dardashti | 211/40 |
| 5,560,499 | A | | 10/1996 | Dardashti | 211/40 |
| 5,595,312 | A | | 1/1997 | Dardashti | 211/188 |
| 5,607,068 | A | * | 3/1997 | Coretti, Jr. et al. | 211/59.2 |
| RE35,761 | E | | 4/1998 | Dardashti | 211/40 |
| 5,875,895 | A | | 3/1999 | Dardashti | 206/573 |
| 5,908,121 | A | | 6/1999 | Dardashti | 211/188 |
| 5,947,521 | A | * | 9/1999 | Stucki | 281/20 |
| 6,015,051 | A | * | 1/2000 | Battaglia | 211/51 X |
| 6,116,436 | A | * | 9/2000 | Ferrucci et al. | 211/184 X |
| 6,257,426 | B1 | * | 7/2001 | Masunaka et al. | 211/187 |

OTHER PUBLICATIONS

InterMetro Industries Corporation; Metro catalog sheet 10–01; Super Erecta Shelf® Wire Shelving; 1997.

InterMetro Industries Corporation; Metro catalog sheet 10–01; Super Erecta Shelf® Wire Shelving; Rev. 3/98 BJ.

InterMetro Industries Corporation; Metro catalog sheet 10–01A; Super Adjustable Super Erecta Shelf® Wire Shelving™; 1999.

InterMetro Industries Corporation; Metro catalog sheet 10–01A; Super Adjustable Super Erecta Shelf® Wire Shelving; Rev. 5/99.

(List continued on next page.)

*Primary Examiner*—Daniel P. Stodola
*Assistant Examiner*—Erica B. Harris
(74) *Attorney, Agent, or Firm*—Oppenheimer Wolff & Donnelly LLP

(57) ABSTRACT

A wire shelving has a plurality of support surfaces stacked with rods one above the other, the support surfaces each have spaced longitudinal wires. A wire divider assembly is positionable by the user to any desired position along the wires to provide an end stopper to hold media upright. The divider assembly preferably has an M shape with a pair of long legs. Outwardly-facing C-shaped couplers are secured at the ends of the legs, each having an elongate slot generally perpendicular to its respective leg and disposed outwardly. To position the assembly on the desired support surface and at the desired place on the support surface, the user squeezes the legs towards one another, moves the assembly to the desired place and releases the legs so that the couplers expand out onto and engage onto the respective wires. To reposition the assembly, the user squeezes the legs to release the couplers from the wires and moves the assembly to the new position on the same or different support surface. In alternative embodiments of the divider assembly, the legs may be angled or offset from the vertical plane of the couplers in order to provide for a finger insertion area near the couplers.

17 Claims, 8 Drawing Sheets

OTHER PUBLICATIONS

MoreOnline: More Info; Office Products catalog pages; Kl Lateral File Dividers, 3–PK; Feb. 17, 2000 (2 pages).
OfficeDepot.com catalog page; File Accessories for HON® Lateral Files, Dividers; Feb. 17, 2000.
the posse, inc; color coded filing systems; stable shelving storage cabinets; catalog page; Feb. 17, 2000; 2 pages.
Metro Shelving; catalog pages; Shelving; Feb. 18, 2000.
Atlantic, Inc.; Penguin; cd hodler shelving catalog sheets; Mar. 3, 2000; 2 pages.
Atlantic, Inc.; Gallery Towers, Metal; shelving catalog sheets; Mar. 3, 2000; 2 pages.

Atlantic, Inc.; Rhino Collections, cd shelving catalog sheet; Mar. 3, 2000.

Gaylord.com; Shelving, Stools, Ladders catalog sheets; Mar. 3, 2000; 6 pages.

* cited by examiner

FIG. 9A
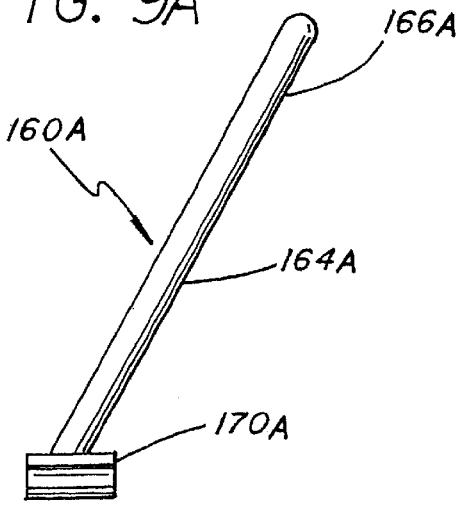
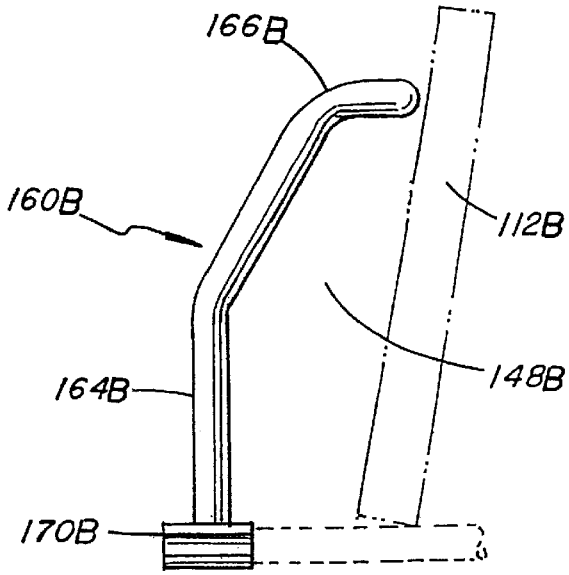
FIG. 9B
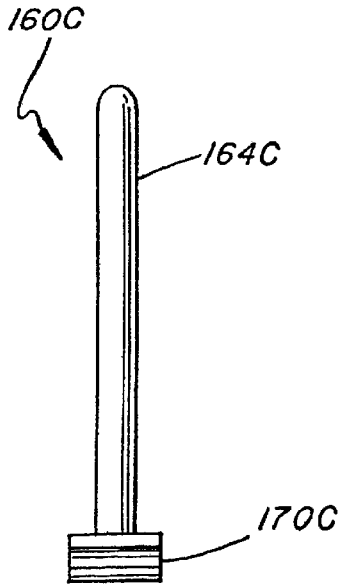
FIG. 9C
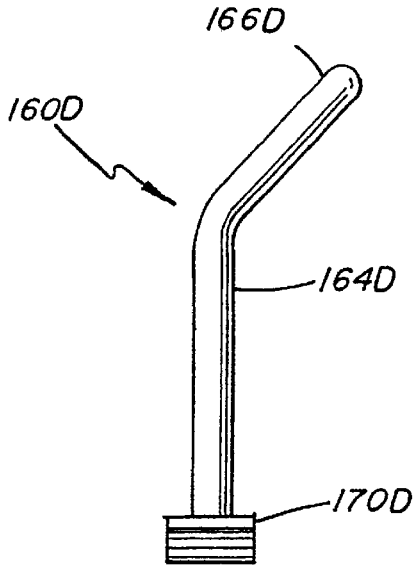
FIG. 9D

WIRE SHELVING WITH ADJUSTABLE DIVIDER ASSEMBLY FOR MULTIMEDIA AND THE LIKE

BACKGROUND OF THE INVENTION

Many different and popular storage systems are known for storing and displaying compact discs, digital video discs, video tapes and/or other packaged or encased multimedia. Examples thereof are disclosed in the following U.S. Pat. Nos.: 5,195,642 (Dardashti), 5,553,720 (Dardashti), 5,560,499 (Dardashti), 5,595,312 (Dardashti), 5,875,895 (Dardashti), and 5,908,121 (Dardashti). (The entire contents of each of these patents are hereby incorporated by reference.) However, there is a need for a system that can store and display large numbers of multimedia, upright in an attractive book fashion, with the titled spines thereof one against the other, easily readable by the user. This system should have the flexibility to store and display varying numbers of multimedia in changeable attractive arrangements to accommodate the user's varying needs and desires.

SUMMARY OF THE INVENTION

Accordingly, disclosed herein is a multimedia storage rack having at least one shelf and preferably a plurality of shelves, held in a bookcase fashion by corner posts, spaced one above the other. At least one of the shelves has a support surface which includes a pair of longitudinal wires. At least one wire divider assembly or unit of the present invention is provided to attach in an upright orientation to the longitudinal wires at the position desired by the user.

The wire divider assembly has first and second legs, a first coupler at an end of the first leg and a second coupler at an end of the second leg. The couplers both face outwardly such that when the legs are manually squeezed towards one another, the couplers move towards one another. The couplers can then be positioned between the wires. And when the legs are released the couplers each engage a respective wire. The wire divider assembly is thereby releasably held at the desired position along the wires and on the support shelf and in a substantially vertical position on the shelf. The wire divider assembly defines a bookend-type stop for the upright multimedia (or other substantially flat articles) on the support surface.

If the user desires to remove or reposition the wire divider assembly on the support shelf, he simply squeezes the legs to disengage the couplers from their wires, lifts the assembly up and away from the wires and moves the assembly to a different location along the wires, on wires of a different shelf or to a storage location and releases the legs. Alternatively, if he only wants to reposition the assembly on the wires of that shelf, he need not lift the assembly up from the wires after squeezing the legs but can simply squeeze the legs to release the lock of the couplers on the wires and slide the assembly along the wires to another location on the. shelf and then release the legs so that the couplers engage the wires at the new desired location.

The wire divider assembly can take any of a number of configurations or constructions. One construction includes the assembly having an M shape with the legs defining opposite legs of the M and the couplers defining feet at the ends of the legs. And the couplers each are preferably formed as cylinders with respective outwardly-disposed longitudinal slots for engaging the wires. The cylinders are perpendicular to the legs and may be welded to their ends or otherwise permanently attached. The couplers and M shape structure are formed from steel wire, and the M shape, which includes both of the legs, is preferably formed from a single wire strand.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIGS. 4A and 4B show a strap assembly for securing the shelving and divider assembly of FIG. 2 to a wall or the like;

FIGS. 9A–9D are side elevational views of different embodiments of the divider assembly of the present invention.

DETAILED DESCRIPTION OF THE INVENTION

Figure 2:
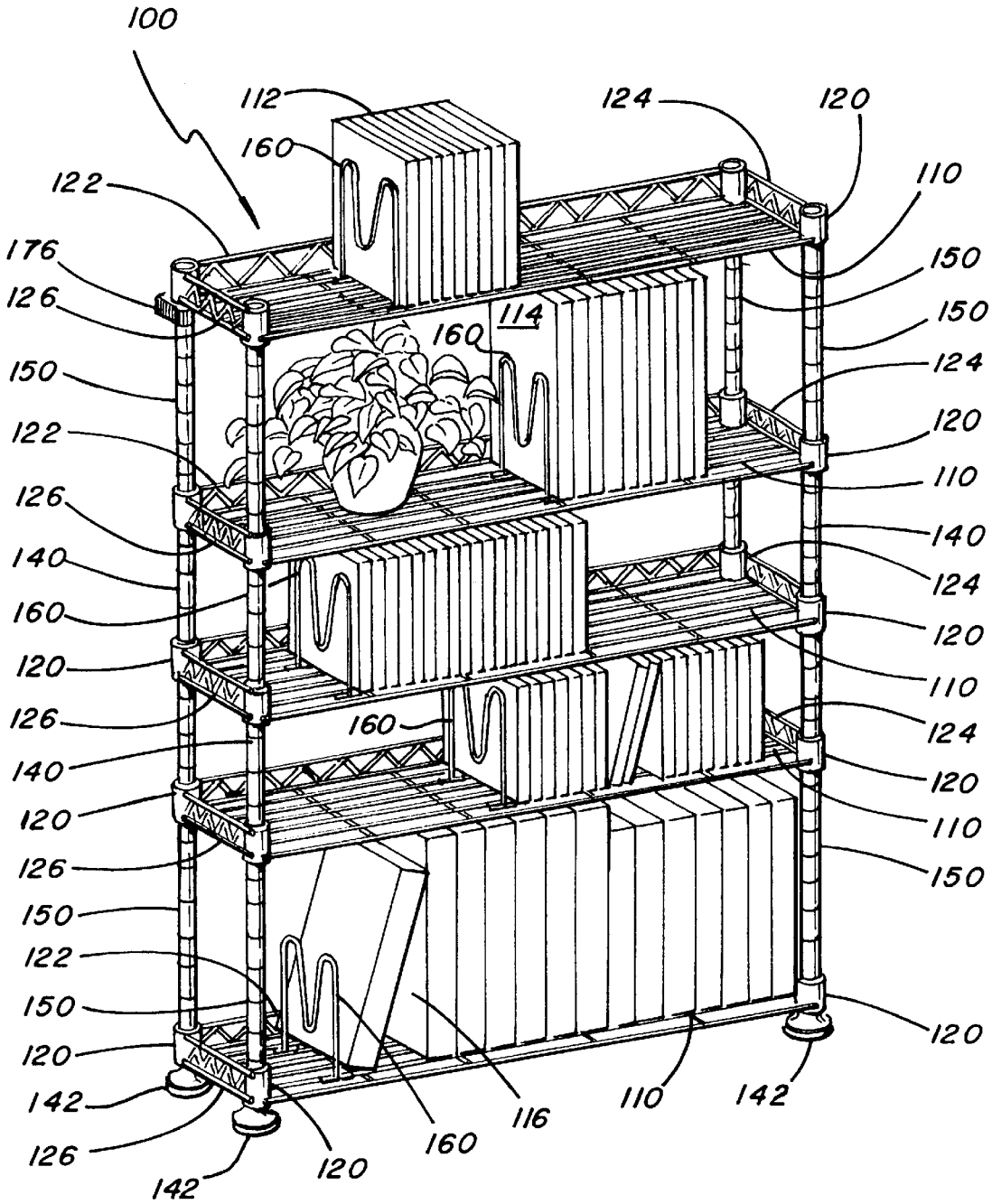
FIG. 2 is a perspective view of the shelving and divider assembly of FIG. 1 shown assembled and with media stored thereon.

A wire shelving assembly of the present invention is shown assembled in FIG. 2 generally at 100. Wire shelving assembly 100 is similar to the METRO Shelving available from InterMetro Industries Corporation of Wilkes-Barre, Pa. Assembly 100 includes a plurality of wire shelves 110 stacked one on top of the other and spaced from each other by rods 150 passing through or disposed in cylinders at the comers 120 of each of the shelves. Each of the shelves 110 has end walls 124 and 126, a rear wall 122 and an open front, and the support surface is formed by longitudinal wires. These wires extend from one end (or rear wall) of the shelf to the other, and are held in spaced parallel position by lateral wires extending from front to back on the shelves. While six longitudinal wires and four lateral wires are shown in the drawings, other numbers of longitudinal and lateral wires can be used as would be apparent to those skilled in the art.

Figure 1:
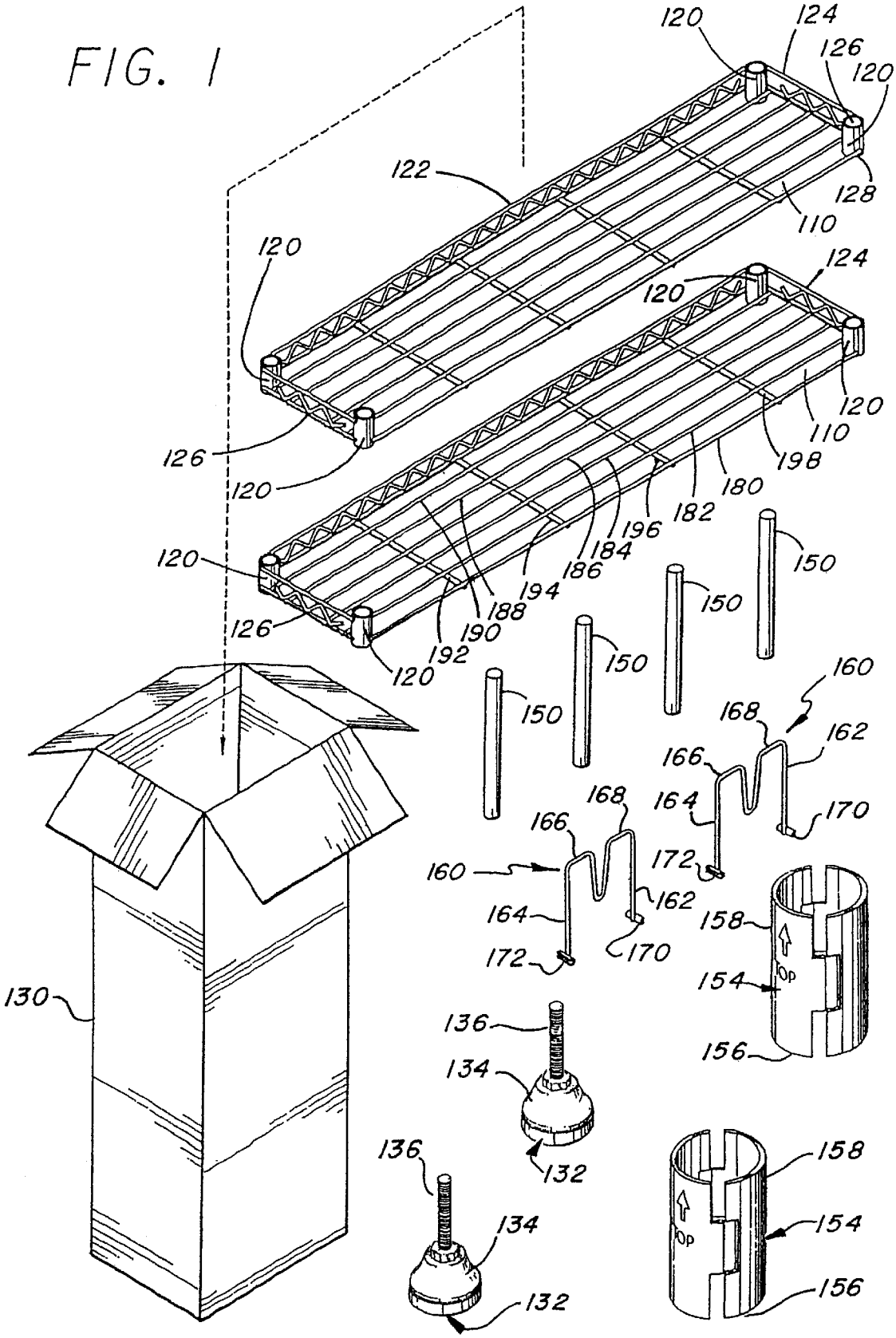
FIG. 1 is a perspective view of portions of a wire shelving with adjustable divider assembly of the present invention shown disassembled and being packed into a carton for retail sale.

FIG. 1 shows some of the components of the wire shelving assembly 100 of FIG. 2 disassembled as it may be packaged in carton 130 for shipment in retail sale. A customer can open the carton 130 and remove a plurality of shelves 110 each with end walls 124 and 126, a rear wall 122, and cylinders at each of the corners 120 of the shelves 110. The shelves 110 also include a plurality of longitudinal wires shown at 180, 182, 184, 186, 188, and 190 as well as lateral wires shown as 192, 194, 196, and 198. The number of longitudinal and lateral wires along shelves 110 may be varied.

The carton 130 may also contain a plurality of rods 150, rod bases 132 and stoppers 154. The cylinders at each of the comers 120 of the shelves 110 are hollow and are adapted to receive rods 150 such that the plurality of shelves 110 may be fitted together along the rods, one on top of the other, connected by the rods and stoppers 154. The stopper 154 may be cylindrically shaped such that its diameter is wider at the bottom 156 of the stopper 154 than at the top 158 of the stopper 154. The rod bases 132 are comprised of a head 134 and threaded shaft 136. The head 134 is wider than. the threaded shaft. 136 and acts. as a support base for the shelf assembly 100. The threaded shaft 136 of the rod base 132 compliments an inner threading on the rods 150 such that rods 150 may be screwed onto the rod base 132 through the threaded shaft 136. The carton 130 further contains a plurality of wire divider assemblies 160 which may be positioned along the longitudinal wires to hold media content stored on the shelves 110 upright, as will be described in greater detail.

Referring again to FIG. 2, the wire shelving assembly 100 is shown assembled and with materials stored on shelves 110. The materials stored on the shelves 110 may include media content 112, 114 or 116 in various shapes and sizes. For example, the media content may comprise video cassettes, compact discs, or digital video discs. Additionally, the shelves 110 may hold decorative items such as plants or other items.

Figure 3C:
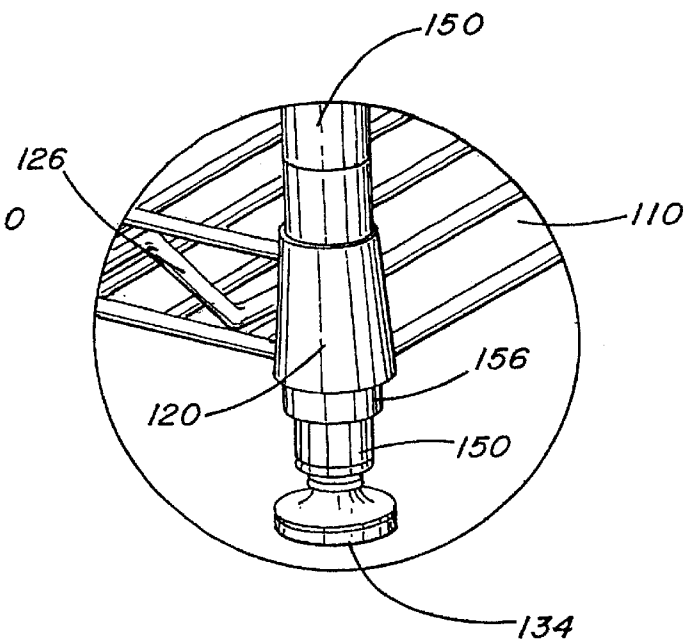
FIGS. 3A, 3B and 3C show steps of an assembly process for the shelving and divider assembly of FIG. 2.
Figure 3B:
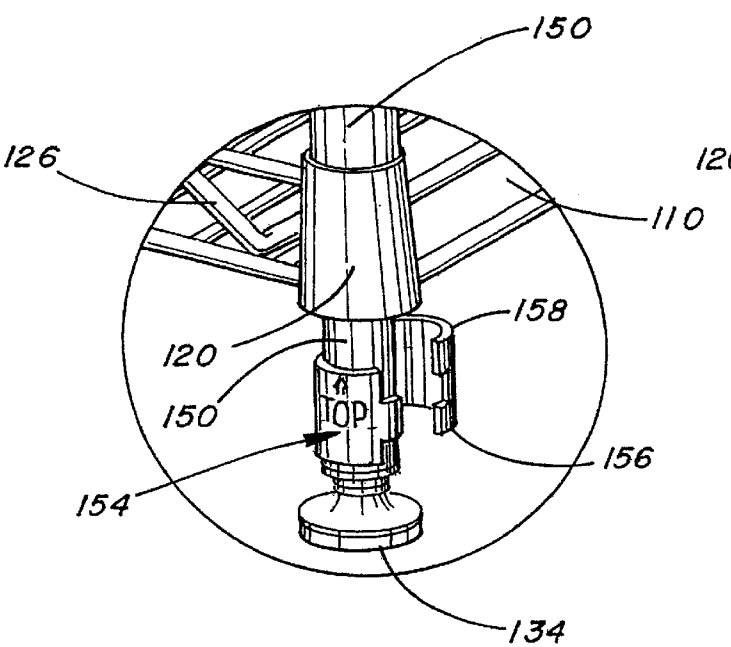
Figure 3A:
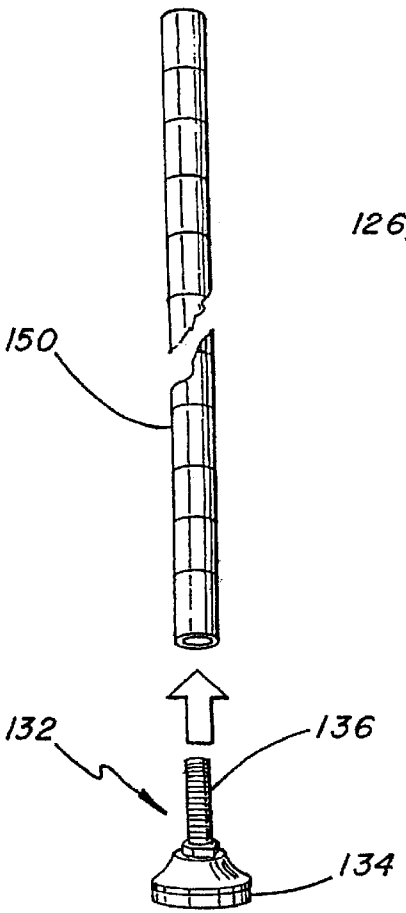
Figure 4A:
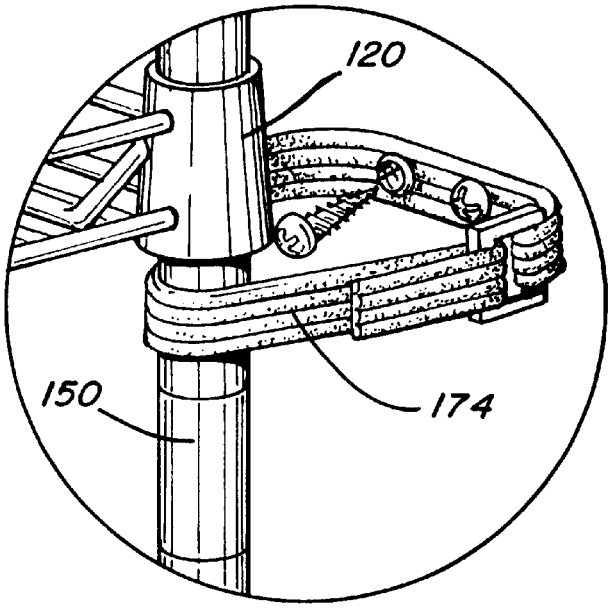
Figure 4B:
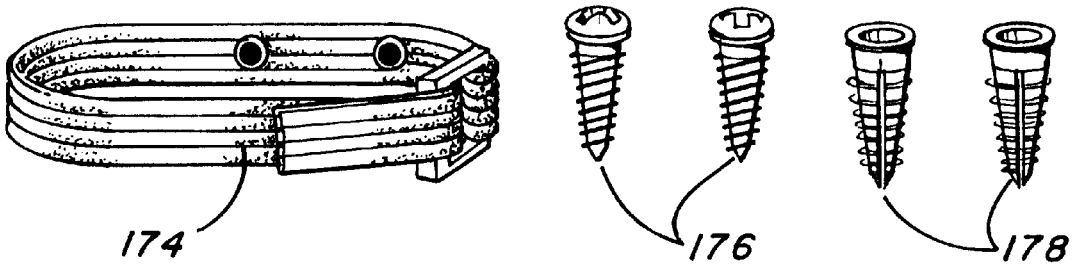

Referring to FIGS. 3A–3C, the wire shelving assembly 100 is easily assembled upon removal of the individual pieces from the carton 130. Specifically referring to FIG. 3A, to assemble the wire shelving unit 100, a customer begins by screwing a rod 150 onto the threaded shaft 136 of a rod base 132. Next referring to FIG. 3B, the customer fastens a stopper 154 onto a rod 150 at any point along the rod 150 where the customer desires a shelf 110. Then referring to FIG. 3C, the customer slides the cylinder 120 of a shelf 110 down over the rod 150 and the top 158 of the stopper 154 until the cylinder 120 is stopped by the bottom 156 of the stopper 154, which is wider in circumference than the top of the stopper 158. This process is repeated along the other three rods 150 to complete the addition of a shelf 110. The entire process is then repeated to add additional shelves 110 so that shelves are added one on top of another spaced apart along rods 150 as desired by the customer. Further, referring to FIGS. 4A and 4B, the shelving assembly 100 includes at least one strap 174 such that the shelving assembly 100 may be secured to a wall for added stability via screws 176 and screw expanders 178, or other securement means. The strap 174 includes at least one hole through which a screw expander 178 and then a screw 176 may be inserted to be attached to a wall or other solid structure.

Figure 5:
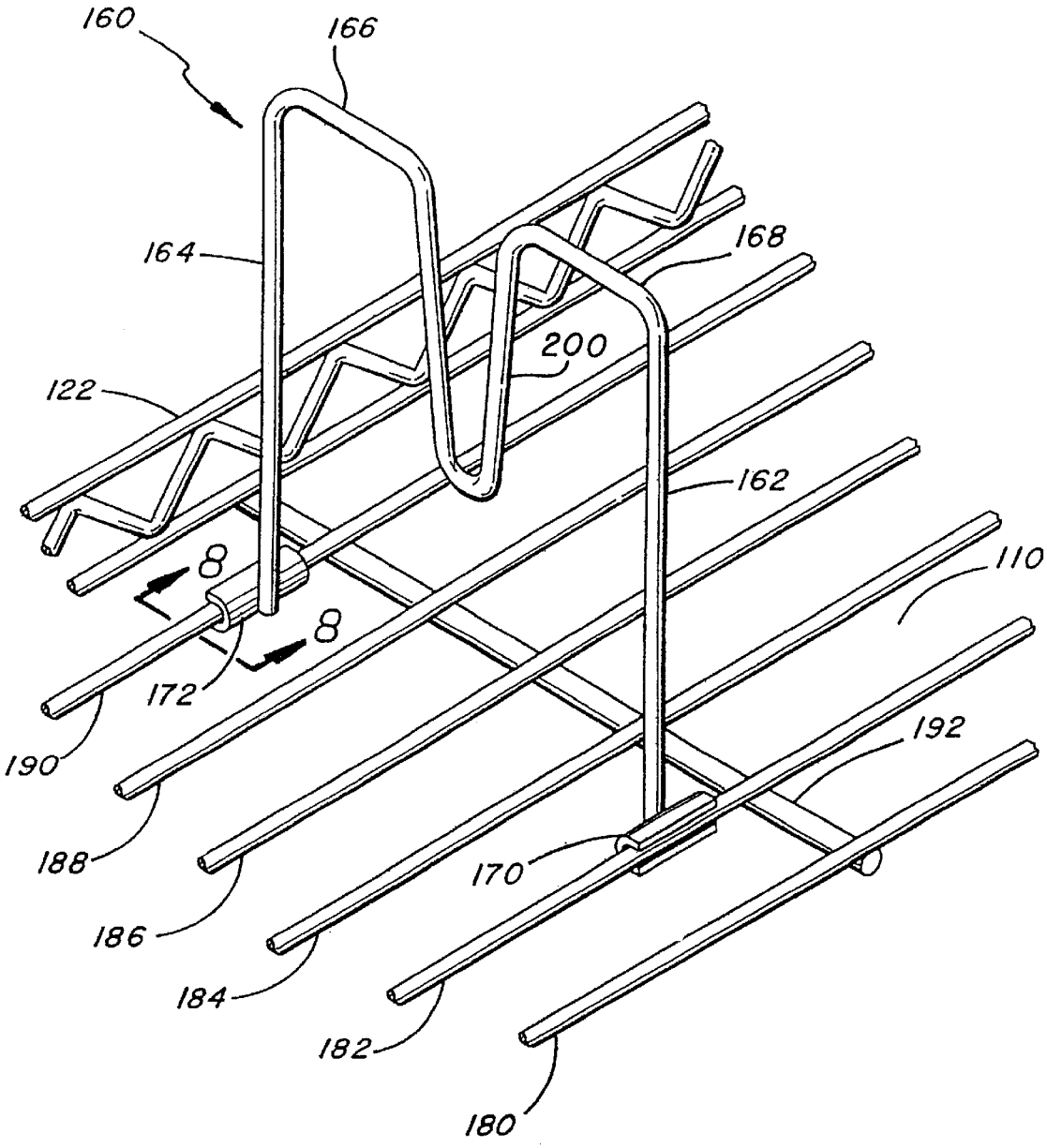
FIG. 5 is an enlarged perspective view of the divider assembly of FIGS. 1 or 2 on the wire shelving.

FIG. 5 shows a divider 160 of the present invention attached to longitudinal wires 182 and 190 of shelf 110 via couplers 170 and 172. Dividers 160 may be added to the shelves 110 to separate and retain upright the media content stored on the shelves 110 according to the user's preference of location for the divider 160 along the shelves 110, as can be understood from FIG. 2. The divider assembly 160 is typically formed from one piece of metal or other suitable material. Additionally, the divider assembly 160 may have an M shape, although a variety of other configurations may be used as will be discussed further below.

The divider 160 can include legs 162 and 164 and a connecting center portion 200. The connecting portion 200 may join the legs 162 and 164 to complete an M shape. However, the connecting portion 200 may alternatively be designed to resemble an article, person, character, trademark or the like. For example, the connecting portion 200 may be shaped like a guitar, the McDonald's arches, the popular Pokeman figure, or a profile outline of Elvis Presley. The divider 160 can also include couplers 170 and 172 which are attached at the ends of the legs 162 and 164. The couplers 170 and 172 include outwardly-facing C-shaped cylinders, each having an elongated slot generally perpendicular to its respective leg and disposed outwardly.

The divider 160 may be moved between lateral wires to numerous positions along the longitudinal wires shown in FIG. 5 as wires 182 and 190. Additionally, the width of the divider 160 may be configured such that the divider attached between several combinations of longitudinal wires. For example, the width of divider 160 may be increased and the divider 160 may be configured to attach to the shelf 110 along longitudinal wire 180 and rear wall 122. Or, the width of divider 160 may be decreased and the divider 160 may be attached to the shelf 110 along longitudinal wires 188 and 182 or 186 and 182, for example.

Referring again to FIG. 1, the divider 160 may be moved between end wall 126 and lateral wire 192, between wires 192 and 194, between wires 194 and 196, between wires 196 and 198, or between wire 198 and end wall 124. Alternatively, the divider 160 may be moved from one location to any other location. For example, the divider 160 may be relocated from between end wall 124 and wire 198 to between wires 192 to 194. Thus, the divider 160 may be configured to an infinite number of positions along a shelf 110.

Figure 6:
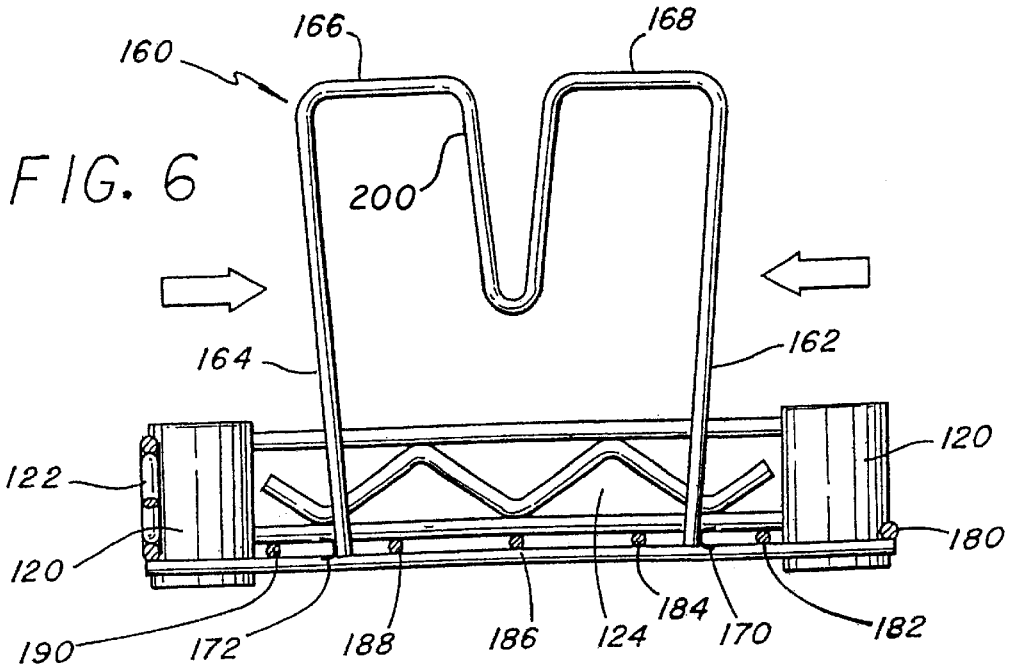
FIG. 6 is an enlarged cross-sectional view showing a divider assembly of FIG. 5 being squeezed for repositioning on or removal from the wire shelving.

To relocate a divider 160 a user squeezes the legs 162 and 164 towards one another to disengage the couplers 170 and 172 from the wires, as shown in FIG. 6. Then the user may either slide the divider 160 to a new location between current lateral wires or may lift the divider 160 away from the current lateral wires. If the user decides to lift the divider 160 away from the current lateral wires, once the user has identified a new location for the divider 160, the user again squeezes the legs 162 and 164 towards one another so that the couplers 170 and 172 may be positioned to contact the wires through the outwardly-facing C-shaped cylinders. Alternatively, if the user decides to merely reposition the divider 160 between the existing lateral wires, the user may maintain the pressure applied to legs 162 and 164 so that couplers 170 and 172 remain in partial contact with the wires. This way, the divider 160 is moveable since couplers 170 and 172 are not in full contact with the wires as the user slides the divider 160 to a new position. Once the new position is reached, the user may release legs 162 and 164 such that couplers 170 and 172 become fully secured again to wires 182 and 190.

As seen in FIGS. 2 and 5, the divider 160 may be uniquely adjusted to infinitely different positions along wires 182 and 190 such that it may be configured to an exact individual's need for media storage. Further, the divider 160 is easily adjusted by applying easy manual pressure to legs 162 and 164 and sliding the divider 160 along the wires.

Figure 7:
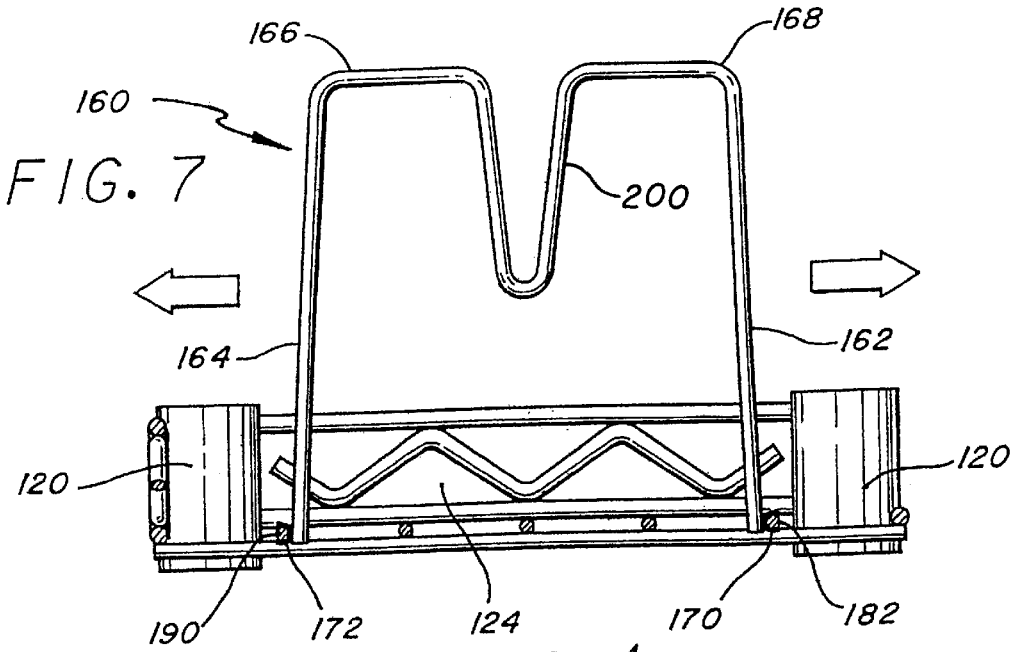
FIG. 7 is a view similar to FIG. 6 showing the repositioned divider assembly being released into its new position on the wire shelving.

FIG. 6 illustrates the divider 160 when the user wishes to lift the divider 160 away from the current wires with the legs 162 and 164 squeezed towards one another. In the squeezed position, the couplers 170 and 172 no longer connect with wires 182 and 190. FIG. 7 then shows the divider 160 in its normal configuration after the legs 162 and 164 have been released and pressure is no longer applied. In this position, the couplers 170 and 172 again directly contact wires 182 and 190 via the outwardly-facing C-shaped cylinders.

By squeezing legs 162 and 164 towards one another, the couplers 170 and 172 will disengage from wires 182 and 190. This allows the user to relocate the divider 160. The amount of tension supplied by the user when squeezing the legs 162 and 164 controls the amount of movement allowed by the couplers 170 and 172. Thus, as discussed above, the user may squeeze the legs 162 and 164 slightly to merely slide the divider 160 between the current lateral wires where lateral wire 192 is shown as a stopping point at one end. Or the user may use slightly more force to relocate the divider 160 by lifting the divider 160 up and away from the wires. Then to reposition the divider 160, the user must squeeze legs 162 and 164 such that couplers 170 and 172 reconnect with wires 182 and 190.

Figure 8:
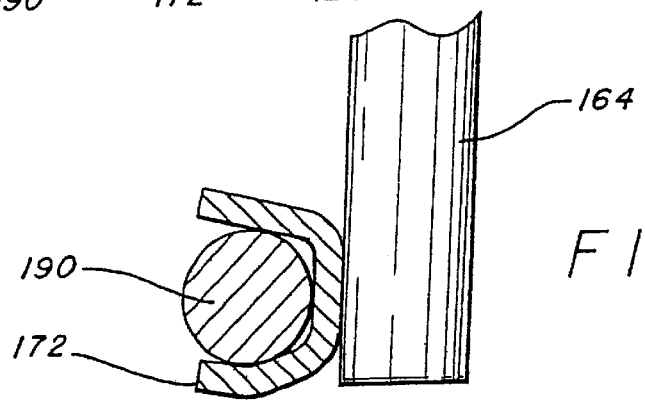
FIG. 8 is an enlarged cross-sectional view taken on line 8—8 of FIG. 5.

FIG. 8 is an enlarged cross-sectional view taken along line 8—8 of FIG. 5 and shows one leg 164 and the attached coupler with C-shaped cylinder 170 contacting longitudinal wire 190. When leg 164 is squeezed, coupler 172 begins to move away from wire 190. Thus, when slight pressure is applied to leg 164, coupler 170 becomes loose and may slide along wire 190. But when more pressure is applied, coupler 170 is pulled completely away from wire 190 such that leg 164 is no longer attached to wire 190.

FIG. 9 shows a cross-sectional view of an alternative embodiment for the divider 160. In FIGS. 9A–9D, the divider 160 is shown in a variety of embodiments whereby the divider 160 is angled at the top 166. In these embodiments, the leg 164 may bend between couplers 170 and 172 and the tops 168 and 166 of the legs 162 and 164. As shown in FIG. 9A, the bend may be gradual beginning near the couplers 170 and 172 and continuing to the tops 168 and 166 of the legs 162 and 164. Or as seen in FIG. 9B, the bend may occur more sharply at a distance from the couplers 170 and 172.

Alternatively, FIGS. 9C and 9D show that the divider 160 may be formed such that the divider 160 may be moved or snapped between two positions such that the first position maintains the divider in a vertical position in FIG. 9C and the second position allows the divider 160 to be offset at an angle from the vertical plane of the coupler 170 in FIG. 9D. Thus, the embodiment shown in FIG. 9D allows the top of the divider 166 to be angled away from the vertical plane of the coupler 170 while the user is positioning the divider 160 on the shelf 110. Then after the divider 160 has been positioned on the shelf 110, the top 166 may be moved back to the vertical plane of the coupler 170 to maximize the amount of media content 112, 114, or 116 that may be stored on the shelf 110.

These alternative embodiments of the divider 160 allow for easier positioning along the shelf 110 because the divider holds the materials further away from the user's fingers so the user has more space near the couplers 170 and 172 with which to insert or move the divider 160 on the shelf 110. Referring again to FIG. 9B, media content 112 as stored on a shelf 110 is shown. Between the media content 112 and the angled divider 160 a finger insertion area 148 is defined which provides space for the user's fingers near the coupler 170 so that the user may easily insert the coupler 170 onto the shelf 110. The angle of the divider 160 in these alternative embodiments may vary and is shown as approximately thirty degrees in FIG. 9B.

Figure 10C:
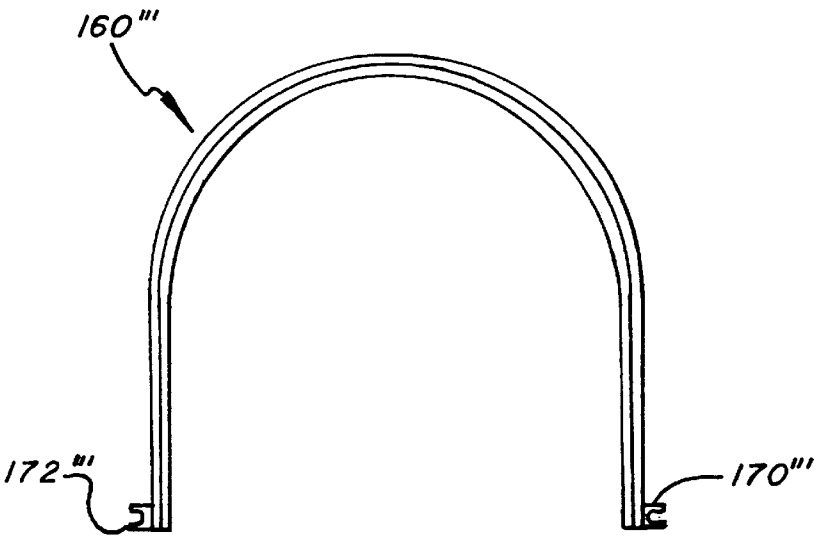
FIGS. 10A, 10B and 10C are front elevational views of alternative embodiments of the divider assembly.
Figure 10B:
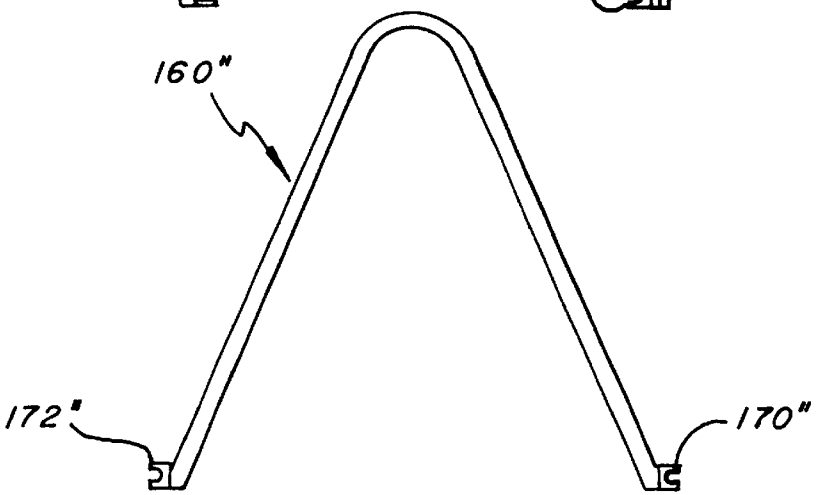
Figure 10A:
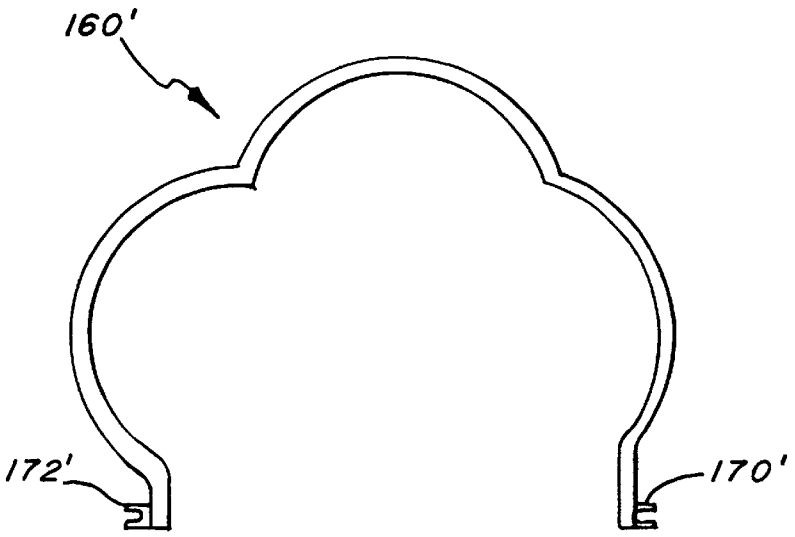

FIGS. 10A, 10B and 10C show some alternative configurations for the divider 160. In FIG. 10A, the, divider 160' is shown shaped having a three leaf clover shape. The divider 160' still holds media content upright along shelf 110 and attaches to shelf 110 via couplers 172' and 170'. FIG. 10B shows the divider 160" as an upside down V and also includes couplers 172" and 170" for attachment to the shelf 110. In FIG. 10C, the divider 160'" is shown as an upside down U with couplers 172'" and 170'". Any number of variations of shapes for the divider 160 may also be used such that the divider 160 acts to hold the materials on the shelf 110 upright or in place.

From the foregoing detailed description, it will be evident that there are a number of changes, adaptations and modifications of the present invention which come within the province of those skilled in the art. For example, the couplers 170 and 172 of the divider 160 need not attach to a wire and instead the couplers 170 and 172 may attach to a plate with a rounded end. However, it is intended that all such variations not departing from the spirit of the invention be considered as within the scope thereof as limited solely by the claims appended hereto.

What is claimed is:

1. A multimedia storage rack assembly, comprising, a first shelf having a first horizontal support surface, a plurality of first corner members, a first rear wall, and a pair of opposing first side walls;

the first rear wall and the first side walls extending above the first horizontal support surface;

the first support surface including a pair of longitudinal first wires disposed parallel to the first rear wall;

the first support surface being adapted to support a substantially flat article level and upright with a spine of the article upright and facing forwardly;

a second shelf having a second horizontal support surface, a plurality of second comer members, a second rear wall, and a pair of opposing second side walls;

the second support surface including a pair of longitudinal second wires disposed parallel to the second rear wall;

the second support surface being adapted to support a substantially flat article upright with a spine of the article upright and facing forward;

a plurality of elongate connector members, the connector members connecting respective ones of the first and second comer members and thereby supporting the first shelf above the second shelf; and a first wire divider assembly having first and second legs, a first coupler at an end of the first leg and a second coupler at an end of the second leg, the couplers disposed such that when the legs are manually squeezed together towards one another, the couplers can be positioned between the pair of longitudinal first or second wires and when the legs are released the couplers engage outwardly against a respective one of the wires of the pair of longitudinal first or second wires, thereby releasably holding the first wire divider assembly at an adjustable position along the first or second wires to define a support stop for the substantially flat article on the first or second support surface.

2. The assembly of claim 1 wherein the couplers both face outwardly.

3. The assembly of claim 1 wherein the first shelf is a wire shelf.

4. The assembly of claim 1 wherein the corner members taper upwardly.

5. The assembly of claim 1 further comprising:

a second wire divider assembly having third and fourth legs, a third coupler at an end of the third leg and a fourth coupler at an end of the fourth leg, the couplers disposed such that when the third and fourth legs are manually squeezed together towards one another, the third and fourth couplers can be positioned between the pair of longitudinal first or second wires and when the third and fourth legs are released the couplers engage outwardly against a respective one of the wires of the pair of longitudinal first or second wires, thereby releasably holding the second wire divider assembly at an adjustable position along the first or second wires to define another support stop for a substantially flat article on the first or second support surface.

6. The assembly of claim 1 wherein the couplers both have longitudinal C-shapes.

7. The assembly of claim 1 wherein ends of the legs are secured to outside surfaces of the couplers.

8. The assembly of claim 1 wherein the first wire divider assembly has an M shape with the legs defining opposite legs of the M and the couplers defining feet at the ends of the legs.

9. The assembly of claim 1 wherein the first wire divider assembly is bent between the couplers and top portion of the legs.

10. The assembly of claim 1 wherein the first wire divider assembly is made of steel.

11. The assembly of claim 1 wherein the first and second couplers are each cylinders with respective outwardly-disposed longitudinal slots.

12. The assembly of claim 1 wherein the legs are directly secured to back surfaces of respective ones of the cylinders.

13. The assembly of claim 1 wherein the first shelf includes additional wires parallel to the wires and also forming part of the first support surface.

14. The assembly of claim 1 wherein the first shelf includes lateral members holding the wires in relative positions.

15. The assembly of claim 1 wherein the substantially flat articles are multi-media.

16. The assembly of claim 1 wherein the stop forms a first stop for a first end of a horizontal row of the vertically-disposed substantially flat articles, and further comprising a second wire divider assembly similar to the first wire divider assembly, wherein the second wire divider assembly forms a second stop for a second end of the horizontal row.

17. The assembly of claim 1 wherein the first wire divider assembly comprises a single wire strand including the first and second legs.

* * * * *